United States Patent [19]

Silzle

[11] Patent Number: 4,697,392

[45] Date of Patent: Oct. 6, 1987

[54] AIRPLANE HANGAR

[76] Inventor: Siegfried Silzle, Im Moos 10, D 8959 Füssen, Fed. Rep. of Germany

[21] Appl. No.: 930,811

[22] Filed: Nov. 13, 1986

[30] Foreign Application Priority Data

Nov. 27, 1985 [DE] Fed. Rep. of Germany ..... 3541868

[51] Int. Cl.[4] ..... E04B 1/346

[52] U.S. Cl. ..... 52/65; 52/175; 52/236.4; 244/114 R

[58] Field of Search ..... 52/64, 65, 69, 86, 87, 52/30, 174–176, 236.1–236.4; 244/114 R

[56] References Cited

U.S. PATENT DOCUMENTS

| | | | |
|---|---|---|---|
| 2,964,144 | 12/1960 | Wheeler | 52/65 |
| 3,079,871 | 3/1963 | Brodie | 104/44 |
| 3,438,780 | 9/1982 | Angelo | 14/1 |
| 3,670,464 | 6/1972 | Cutter | 52/30 |

FOREIGN PATENT DOCUMENTS

| | | | |
|---|---|---|---|
| 158735 | 10/1985 | European Pat. Off. | 244/114 R |
| 2101090 | 12/1972 | Fed. Rep. of Germany | 52/64 |

*Primary Examiner*—John E. Murtagh
*Assistant Examiner*—Andrew Joseph Rudy
*Attorney, Agent, or Firm*—Angelo Notaro

[57] ABSTRACT

In the spaced between a plurality of airplanes that are supported by a rotatable bottom wall of an airplane hangar, lifting platforms are mounted on pivoting levers. The lifting platforms are adapted to support further airplanes on an elevated level. The lifting platforms can be lowered, thereby moving translationally in a radial outward direction. A single hydraulic cylinder arrangement is mounted in a sector containing a movable door section of the hangar peripheral wall. Each lifting platform, upon rotation into that sector, is automatically coupled to the cylinder arrangement for swinging the lifting platform downwards onto the level of the rotatable bottom wall. The lifting platform, after having been raised again, is automatically disengaged from the cylinder arrangement when it leaves that sector.

11 Claims, 2 Drawing Figures

AIRPLANE HANGAR

BACKGROUND OF THE INVENTION

The invention relates to an airplane hangar comprising a generally circular peripheral wall containing a movable door section further comprising a rotatable bottom wall on which a plurality of airplanes are supported with their tail surfaces adjacent. Upon rotation of the bottom wall each one of the plurality of airplanes can be moved to the sector of the hangar containing the movable door section and then can leave the hangar radially through the door opening.

From U.S. Pat. No. 2,964,144 such a hangar is known. However, ultilization of the circular hangar is small because of the airplane wings.

FR Pat. No. 1,524,844 shows a way to reduce the interspaces between a plurality of airplanes respectively. Each second airplane of a linear row of a side-by-side arrangement of airplanes is placed on a lifting platform and can be raised thereon into an elevated position in which the wings thereof overlap the wings of adjacent airplanes. However, the pivoting means and the drive means for each lifting platforms are heavy and expensive structures and additionally because of the necessary tooth racks this concept cannot be used in connection with a rotable bottom wall.

BRIEF SUMMARY OF THE INVENTION

One object of the invention is to provide an airplane hangar using the known concept of a rotatable bottom wall but which has a better utilisation by alternately arranging the airplanes on different levels, thereby minimizing the interspaces of adjacent airplanes.

One further object of the invention is to provide a novel hangar, in which a plurality of longitudinal lifting frames are mounted on a rotatable bottom wall with the longitudinal extensions thereof radially directed.

One further object of the invention is to provide a simple and inexpensive swinging arrangement for each lifting platform which avoids deep pits below the bottom wall and even enables the bottom wall to be free from recesses.

Last, but not least, it is an object of the invention to provide a single simple stationary drive mechanism for at least one group of the plurality of lifting platforms and to provide that each platform of this group in a preselected position can be coupled to the drive mechanism in order to be operated between an elevated position and a lowered position and vice versa.

It is one further object of the invention to provide an airplane hangar which comprises one or a plurality of the following features: a peripheral wall of generally circular configuration adapted to house a plurality of aircraft with their tail surfaces adjacent, at least one movable door section within said peripheral wall, a bottom wall, rotatably arranged about a vertical central axis, a plurality of oblong horizontal lifting platforms radially arranged on said rotatable bottom wall with interspaces allowing an airplane to be positioned therebetween, each one of the lifting platforms supported by four parallel pivoted levers of equal length adapted to move the lifting platform translationally from an elevated position downwards and radially forwards into a lower position substantially on the level of the bottom wall, a single driving means for at least a group of said plurality of lifting platforms, said driving means mounted stationary in an area of a sector containing the door sections and comprising coupling means for automatically coupling each one of said plurality of lifting platforms being rotated into said sector to the driving means and coupling out upon leaving said sector. Thanks to the invention a simple and inexpensive airplane hangar is gained, which therefore is especially appropriate for parking a plurality of sporting planes within a relatively small space.

These and other features of the invention will become apparent from the following description of an embodiment of the invention in connection with the drawing and the claims.

DESCRIPTION OF AN PREFERRED EMBODIMENT

Figure 2:
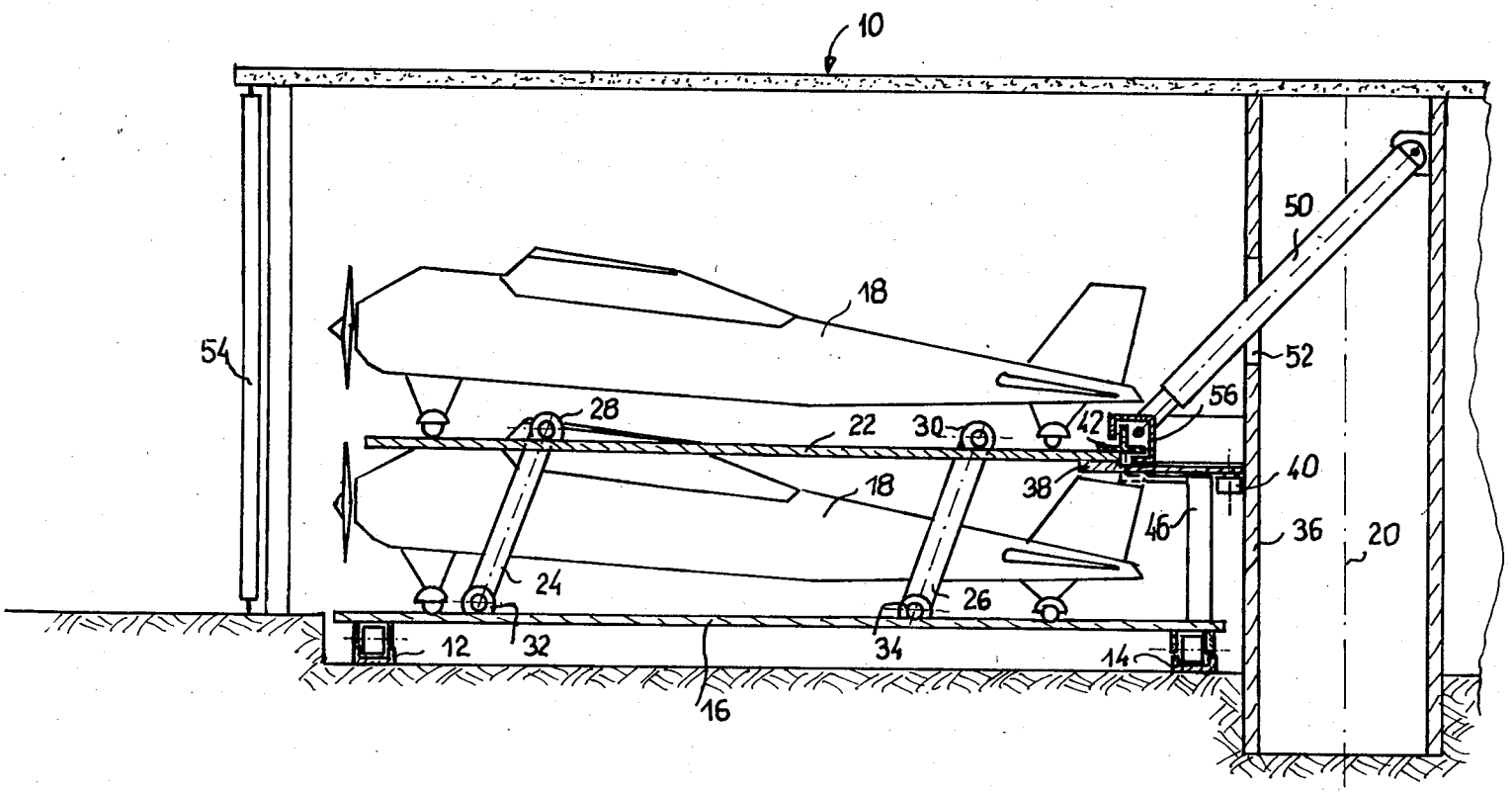
FIG. 2 is a cross-sectional view taken along line 2—2 of FIG. 1.

An airplane hangar 10 comprises a bottom wall 16 mounted for rotation about a central axis 20 on coaxial circular railways 12,14. A plurality of airplanes 18 are radially arranged on the bottom wall 16. The interspace between the wings of adjacent airplanes resting on the bottom wall 16 is somewhat larger than the largest width of the airplane bodies. Between adjacent airplanes 18 respectively lifting platforms 22 of oblong shape are arranged which extend radially with their longitudinal extensions. At each side of each lifting platform 22 a front lever 24 and a rearward lever 26 is pivoted. All levers 24, 26 are of equal length and remain in parallel relationship during their pivoting motions. The upper ends of the levers 24,26 are mounted in front and rearward bearings 28,30 of the lifting platform 22 respectively and the lower ends thereof are pivotably connected to bearings 32,34 fastened on the bottom wall 16. Thanks to this parallelogram suspension of the lifting platform 22 the latter can be moved translationally upwards from an elevated resting position shown in FIG. 2 into an intermediate uppermost position and then downwards into a lowermost position substantially on the level of the bottom wall 16. In the resting position of the lifting platform 22 the levers 24,26 are rearwardly inclined and form an angle of 20° with the vertical upward direction. In this resting position a projection 38 extending rearwardly from the lifting platform 22 abuts against a coaxial vertical central tube 36 by means of a roller 40 mounted at the rearward end of the projection 38. The lifting platforms 22 are supported thereby in their resting positions at the central tube 36 thus avoiding any locking means. When the bottom wall 16 is rotated the rollers 40 run around the periphery of the central tube 36. At the rearward end of each lifting platform 22 an arc-shaped rail section 42 of T-shaped cross-section is fastened extending coaxially to the central axis 20. Each interspace between adjacent rail sections 42 is bridged by a similar rail portion 44, which is mounted on the rotatable bottom wall 16 by means of a vertical strut 46. Therefore the alternate rail sections 42 and the rail portions 44 form a continuous circular railway 48 interrupted only by small gaps formed between each two adjacent rail pieces.

A single piston-cylinder arrangement 50 forming drive means for operating the lifting platforms 22 is pivoted at the upper end of the central tube 36. The piston-cylinder arrangement 50 extends downwards at an oblique angle to the central tube 36 through a vertical slot 52 in the wall of the central tube 36. At the lower end of the piston-cylinder arrangement 50 a claw 56 is fastened which encompasses the circular rail way 48.

The piston-cylinder arrangement 50 is arranged in that sector containing a movable door section 54 provided in the peripheral wall of the hangar 10 and further extends in a vertical radial plane substantially bisecting the door opening.

Because the claw 56 is in continuous sliding engagement with the circular railway 48, each one of the lifting platforms 22 running into the sector containing the door section 54 upon rotation of the bottom wall 16 becomes automatically coupled to the piston-cylinder arrangement 50 by means of its rail section 42, and in similar way is automatically disengaged from the piston-cylinder arrangement 50 when it leaves that section.

Figure 1:
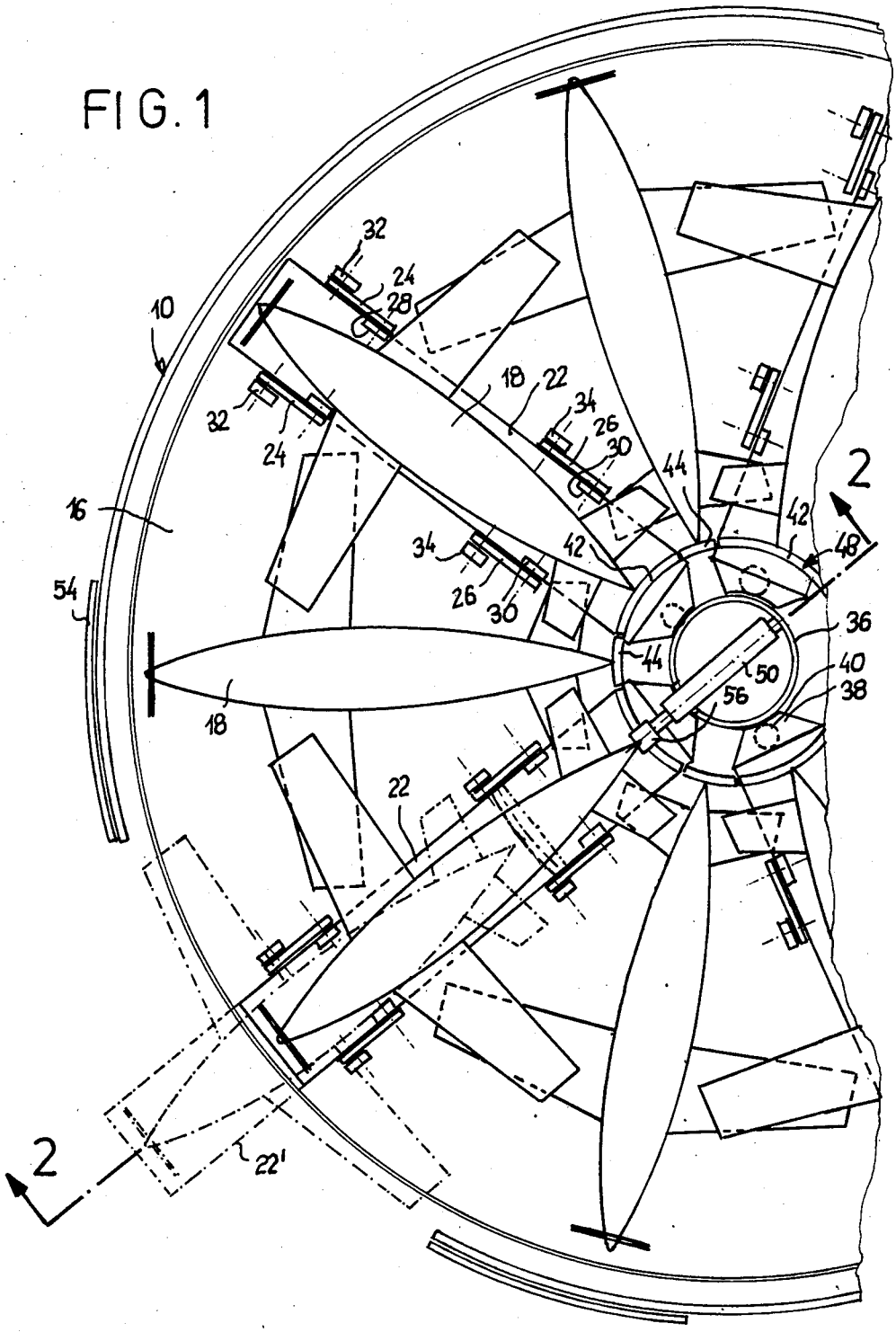
FIG. 1 is a plan view of an airplane hangar comprising a rotatable bottom wall.

Upon operation of the piston-cylinder arrangement 50 the lifting platform 22 is swung forward in the radial direction and initially upwards and after having passed its dead point, is swung downwards substantially onto the level of the bottom wall 16 into the lowermost position 22' thereof as marked with a dot-line and dashes in FIG. 1. In this delivery position the platform 22 extends beyond the periphery of the bottom wall 16 with an amount which is greater than the effective length of the pivoted levers 24,26 and therefore, the lowered lifting platform 22 projects outwardly through the door opening of the hangar 10. During this translational movement of the lifting platform 22 the wings of the airplane 18 supported on the lifting platform 22 freely pass above the wings of both adjacent airplanes 18 on the lower level even if the airplane 18 on the lifting platform 22 is a low wing plane and the adjacent airplanes 18 are monoplanes with high set wings. After having removed the airplane 18 from its lifting platform 22 the latter is moved back into its resting position by operation of the piston-cylinder arrangement 50 and thereafter the bottom wall 16 can be rotated again by a driving motor (not shown), to bring another airplane 18 into its delivery position within the sector as mentioned above.

In a second embodiment (not shown), the vertical webs of each one of the rail portions 44 having a T-shaped or I-shaped cross-section, are connected with web portions welded at the rearward side thereof and projecting in opposite peripheral directions from each one of the rail portions 44. These web portions form limit stops against which the vertical webs of the rail sections 42 of the lifting platforms 22 abut in the resting positions thereof. In this embodiment the rearward projections 38 and the rollers 40 can be missed.

I claim:

1. An airplane hangar comprising a peripheral wall of generally circular configuration adapted to house a plurality of aircraft with their tail surfaces adjacent, at least one movable door section within said peripheral wall, a bottom wall mounted for rotation about a vertical central axis and at a level in said peripheral wall, a plurality of oblong horizontal lifting platforms radially arranged on said bottom wall with interspaces allowing an airplane to be positioned therebetween, each one of the lifting platforms being supported by four parallel pivoted levers of equal length adapted to move the lifting platform translationally from an elevated position downwards and radially forwards into a lower position substantially on the level of the bottom wall, a single driving means for at least a group of said plurality of lifting platforms, said driving means being mounted in an area of a sector containing the door section and comprising coupling means for automatically coupling each one of said plurality of lifting platforms being rotated into said sector to the driving means, and coupling out upon leaving said sector.

2. An airplane hangar as claimed in claim 1, wherein a claw is provided at one end of the driving means, each one of the lifting platforms provided with an arc-shaped rail section, the rail sections of the plurality of lifting platforms extending along a circle having an axis of which coinciding with the axis of rotation of the bottom wall, and wherein the claw is adapted to encompass the rail section of that lifting platform positioned in said sector.

3. An airplane hangar, as claimed in claim 2, wherein a plurality of rail portions substantially having the same cross-section as the rail sections are supported on the bottom wall and extend between said rail sections respectively, a small gap being formed between each rail portion and each adjacent rail section, and wherein the rail portions and rails sections together form a continuous circular railway only interrupted by said gaps.

4. An airplane hangar, as claimed in claim 1, wherein the four pivoted levers in the elevated position of the lifting platform are swung beyond their vertical positions into inclined positions against limit stops holding the lifting platforms in their elevated positions.

5. An airplane hangar, as claimed in claim 2, wherein said rail sections are arranged at the radial inward end of the lifting platform.

6. An airplane hangar, as claimed in claim 1, wherein the pivoting angle of the pivoted levers amounts to at least 100 degrees between a lowermost position at the level of the bottom wall and the elevated position of the lifting platform.

7. An airplane hangar, as claimed in claim 1, wherein said driving means comprises at least one piston cylinder arrangement operated by a pressurized medium and at least generally arranged in a radial plane containing the central axis and intersecting said movable door section, and wherein that end of the piston cylinder arrangement extending away from the movable door section is mounted at a stationary support above the level of the lifting platforms.

8. An airplane hangar, as claimed in claim 1, wherein the width of the lifting platforms is larger at the radial outward ends thereof than at the opposite ends.

9. An airplane hangar, as claimed in claim 1, wherein said four pivoted levers at least are substantially parallel with the lifting platform with the latter in its lowermost position.

10. An airplane hangar, as claimed in claim 3, wherein the four pivoted levers in the elevated position of the lifting platform are swung beyond their vertical positions into inclined positions against limit stops holding the lifting platforms in their elevated positions.

11. An airplane hangar, as claimed in claim 10, wherein said bottom-wall-supported rail portions are provided with said limit stops co-operating with the rail sections of the lifting platforms.

* * * * *